US006420822B1

(12) United States Patent
Symons

(10) Patent No.: US 6,420,822 B1
(45) Date of Patent: Jul. 16, 2002

(54) THERMIONIC ELECTRON EMITTER BASED UPON THE TRIPLE-JUNCTION EFFECT

(75) Inventor: Robert Spencer Symons, Los Altos, CA (US)

(73) Assignee: Northrop Grumman Corporation, Woodland Hills, CA (US)

( * ) Notice: Subject to any disclaimer, the term of this patent is extended or adjusted under 35 U.S.C. 154(b) by 0 days.

(21) Appl. No.: 09/354,299

(22) Filed: Jul. 15, 1999

(51) Int. Cl.[7] ..... H01J 1/62

(52) U.S. Cl. ..... 313/346 R; 313/495; 313/310; 313/311; 313/351

(58) Field of Search ..... 313/346 R, 336, 313/346; 315/4, 339; 361/321; 428/952

(56) References Cited

U.S. PATENT DOCUMENTS 4,562,380 A * 12/1985 Dionne ..... 315/4
5,003,428 A * 3/1991 Shepherd ..... 361/321
5,418,070 A * 5/1995 Green ..... 428/952
5,777,432 A * 7/1998 Xie ..... 313/495
5,795,208 A * 8/1998 Hattori ..... 445/50
5,936,334 A * 8/1999 Gartner et al. ..... 313/346
6,075,315 A * 6/2000 Seko et al. ..... 313/336
6,157,145 A * 12/2000 Vollkommer et al. ..... 315/339
6,197,641 B1 * 3/2001 Hergenrother et al. ..... 438/268

* cited by examiner

*Primary Examiner*—Vip Patel
*Assistant Examiner*—Ken Berck
(74) *Attorney, Agent, or Firm*—O'Melveny & Myers LLP

(57) ABSTRACT

An electron emissive cathode is designed based upon the triple-junction effect. The electron emitting cathode comprises a cathode body having an emitting surface for emitting electrons. A ferroelectric material is impregnated within the cathode body such that the ferroelectric material enhances the emission of electrons from the emitting surface. The cathode body may comprise a tungsten matrix material and the ferroelectric material may comprise a barium titanate, lithium niobate material and/or other known ferroelectrics.

19 Claims, 4 Drawing Sheets

THERMIONIC ELECTRON EMITTER BASED UPON THE TRIPLE-JUNCTION EFFECT

BACKGROUND OF THE INVENTION

1. Field of the Invention

The present invention relates to electron emitting devices, and more particularly, to an electron emitting cathode that operates based upon the triple-junction effect.

2. Description of Related Art

Electron emitting cathodes are used in a variety of devices ranging from cathode ray tubes for display purposes to sophisticated amplifiers used in communication and radar systems for amplifying radio frequency (RF) or microwave electromagnetic signals. For example, it is well known in the art to utilize an electron emitting cathode within a traveling wave tube (TWT), klystron, or other microwave device. In these devices, electrons originating from the electron emitting cathode are focused into a beam and caused to propagate through a tunnel or a drift tube generally containing a RF interaction structure. A RF wave is made to propagate through the interaction structure so that it can interact with the electron beam that gives up energy to the propagating RF wave. Thus, the device may be used as an amplifier for increasing the power of a microwave signal. At the end of its travel, the electron beam is deposited within a collector or electron beam dump, which effectively captures the remaining energy of the spent electron beam. The electron beam may be focused by magnetic or electrostatic fields in the interaction structure of the device to prevent the electron beam from expanding due to space-charge forces and to permit it to effectively travel from the electron gun to the collector without current lost in an undesirable fashion to the interaction structure.

The electron emitting cathode may include some form of heater, such as an internal heater disposed below the cathode surface, that raises the temperature of the cathode surface to a level sufficient for thermionic electron emission to occur. Alternatively, the cathode may be made to produce electrons without the aid of a heater, such as for a cold-cathode gas tube where the electrons are produced by bombardment of the cathode by ions and/or by the action of a localized high electric field. When the voltage potential of an anode spaced from the cathode is made positive with respect to the cathode, electrons are drawn from the cathode surface and caused to move toward the anode.

In addition to the desired electron emission from the cathode in vacuum electron beam devices, there is often undesirable emission from negative electrodes of the devices. In a typical vacuum electron beam device, such as the TWT or klystron noted above, a significant weak point from an electrical breakdown perspective is the interface between a metal, an insulator, and a vacuum. This interface is referred to as a "triple junction" (i.e., metal-insulator-vacuum) and is illustrated in FIG. 1. The triple junction has been positively identified as a source of field emission electrons in vacuum electron beam devices. The inventor first encountered enhanced field emission from a triple junction in the early 1960's when attempting to build a very large, high power klystron. FIG. 2 shows a portion of the prior art klystron that uses an insulator 10 that is cylindrical in shape, approximately twelve inches in diameter and eight inches long, and made of alumina ceramic. The insulator 10 has a negative electrode 12 at one end and a positive electrode 14 at the other end and is immersed in a magnetic field 16 with symmetry about an axis 18 of the insulator 10. The insulator 10 is brazed to the negative and positive electrodes 12 and 14, respectively, after metalizing the ends of the ceramic using the molybdenum-manganese process commonly used to make vacuum-tight brazes between a ceramic and a metal. The magnetic field 16 is stronger at the positive electrode 14 than at the negative electrode 12 so that electrons 20 following a trajectory from a triple junction at the negative electrode 12, upon hitting the positive electrode 14, impinge on a circle having a diameter that is smaller than the diameter of the insulator 10. The insulator 10 was intended to hold off 200–300 kilovolts (kV) DC, but at voltages of approximately 150 kV to 200 kV, an electronic discharge was found to occur between the positive and negative electrodes 12, 14. The power was such that melting would occur at the above-referenced smaller circle on the positive electrode 14 and the electronic discharge would develop into a full-fledged arc.

The personnel at the Lawrence Berkeley Laboratory at the University of California were having similar problems, but with lucite cylinders located between essentially flat metal plates that had been glued to the ends of the lucite cylinder with acrylic cement. Using pinholes to collimate the beam of electrons, they had also discovered that the electrons were coming from the junction between the lucite cylinder and the negative electrode, in other words, at the triple junction. A solution that developed in the electron device community and the physics community was to place short metal cylinders with rounded edges inside and outside the insulating cylinder in such a way that the contact between the insulator and the metal is shielded from electric fields. This solution was applied to the klystron of FIG. 2, as shown in FIG. 3, with the placement of short metal cylinders 22, 24 that act to shield the triple junction from the electric fields. This solved the arcing problem.

Over the years, various theories have been proposed as to the cause of the electron emissions near the triple junction. One such theory is stated by H. Craig Miller, in a paper entitled "Surface Flashover of Insulators," presented at the Workshop On Transient Induced Insulator Flashover In Vacuum (Aug. 24–25 , 1988), sponsored by the Microwave and Pulsed Power Thrust Area of the Lawrence Livermore National Laboratory (CONF-8808171). The Miller paper dealt at length with the initiation of flashover near the triple junction at the negative end of insulators. Miller appeared to support the idea that the enhanced emission of electrons from the triple junction was due to a crack between the insulator and the metal, which produced high electric fields at the surface of the metal. For example, when the insulator is mechanically held in place, a crack would exist at the union between the insulator and the metal. Nevertheless, this theory was refuted by others with experience with brazed ceramics, which generally had no cracks at the union.

Another theory is that an electric field concentration caused by the edge of the metalizing is the source of the problem. For example, during the process of metalizing the surface of the insulator and brazing it to the metal, a fillet of braze material on the surface of the insulator unavoidably forms. This theory in turn is contradicted by the experience with lucite insulators that have no fillet of braze material.

In summary, it is known that electron emission does occur at the triple junction, but no hypothesis that fully explains the triple junction effect has been proposed. It would be very advantageous to avoid the undesired consequences of triple junctions and to provide a cathode that utilizes the triple-junction effect to achieve desired electron emission. The triple-junction cathode would be able to provide electron emissions, such as for an electron gun in an electron beam device, display devices or other devices utilizing emitted electrons in their operation.

SUMMARY OF THE INVENTION

In accordance with the teachings of the present invention, an electron emitter is provided that is based upon the triple-junction phenomena. The electron emitter is based on the hypothesis that, even with the plain parallel equipotentials and parallel electric field lines that would exist between two plain parallel metal plates separated by a cylindrical dielectric insulator, the electric displacement vector and consequently, the surface charge under the ends of the insulator, will be higher than the surface charge outside of the region contacted by the insulator. In theory, there will be an abrupt step function in the surface charge density in the conduction band of the metal at the edges of the insulator. Nevertheless, there is reason to believe that because of the thermal motion of electrons within the metal, the charge density discontinuity cannot, in fact, be abrupt, but rather will reflect the thermal motion of the electrons. For this reason, just outside the insulator, most of the time, there will be greater electron density in the conduction band of the metal than is required to terminate the electric displacement vector. Therefore, it is likely that some of these electrons will escape from the metal into either vacuum or air and the electron emitter, designed based on this phenomena, may take advantage of the electron emission that occurs at or near the triple junction.

In a first embodiment of the present invention, an electron emitting cathode comprises a cathode body having an emitting surface for emitting electrons. A ferroelectric material is impregnated within the cathode body such that the ferroelectric material enhances the emission of electrons from the emitting surface. The cathode body may comprise a tungsten matrix material and the ferroelectric material may comprise a barium titanate, lithium niobate material and/or other known ferroelectrics.

In a second embodiment of the present invention, a method of making an electron emitting cathode comprises selecting an appropriate base material, forming a cathode body from the selected base material having an emitting surface for emitting electrons, and determining an appropriate insulative material to combine with the base material. The emitting surface produces higher electron emissions as the dielectric constant of the insulative material increases. The base material and the insulative material are then combined. The step of combining may further comprise the step of coating the base material with the insulative material or impregnating the base material with the insulative material.

In a third embodiment of the present invention, an electron emitting cathode comprises a first metallic layer having an emitting surface for emitting an electron beam. A second metallic layer is spaced from the first layer and has a plurality of apertures. A high dielectric constant material is provided between the first and second layers and has a plurality of apertures in substantial alignment with the apertures of the second layer. The first and second layers may comprise a metal material and the first layer may comprise a tungsten matrix material. The high dielectric constant material may comprise a ferroelectric material such as barium titanate, lithium niobate and/or other dielectric material. The high dielectric constant material may comprise an individual layer or may be a coating applied to the first layer. The shape of each aperture may comprise a rectangle, a hexagon, a triangle, a circle, or any other grid-like, random or geometric pattern.

In a fourth embodiment of the present invention, an electron beam device comprises a triple-junction cathode that emits electrons focused into a beam. A collector spaced from the cathode is adapted to collect spent electrons from the beam. A radio frequency interaction section is provided between the cathode and the collector and is adapted to cause an interaction between a radio frequency signal and the electron beam. An anode is provided between the radio frequency interaction section and the cathode and is adapted to draw the electron beam from the cathode. The electron beam device may further comprise at least one of a klystron, a traveling wave tube, a triode, a tetrode, a pentode or other gridded structures.

A more complete understanding of the thermionic electron emitter that is based upon the triple-junction effect will be afforded to those skilled in the art, as well as a realization of additional advantages and objects thereof, by a consideration of the following detailed description of the preferred embodiment. Reference will be made to the appended sheets of drawings that will first be described briefly.

DESCRIPTION OF THE PREFERRED EMBODIMENT

Figure 1:
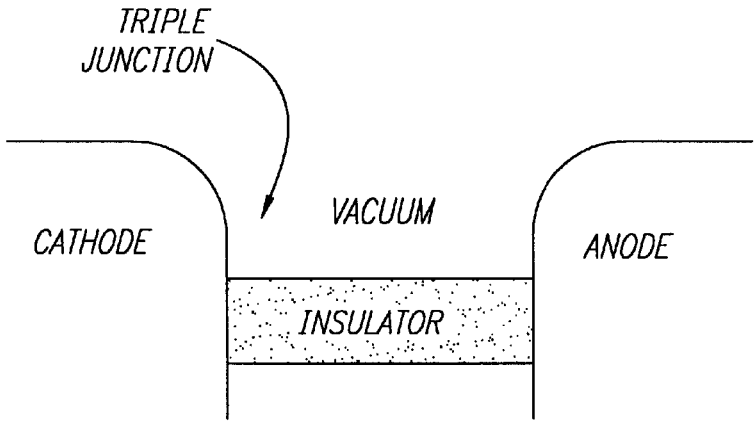
FIG. 1 is a diagram showing the metal-insulator-vacuum union known as a triple junction.
Figure 2:
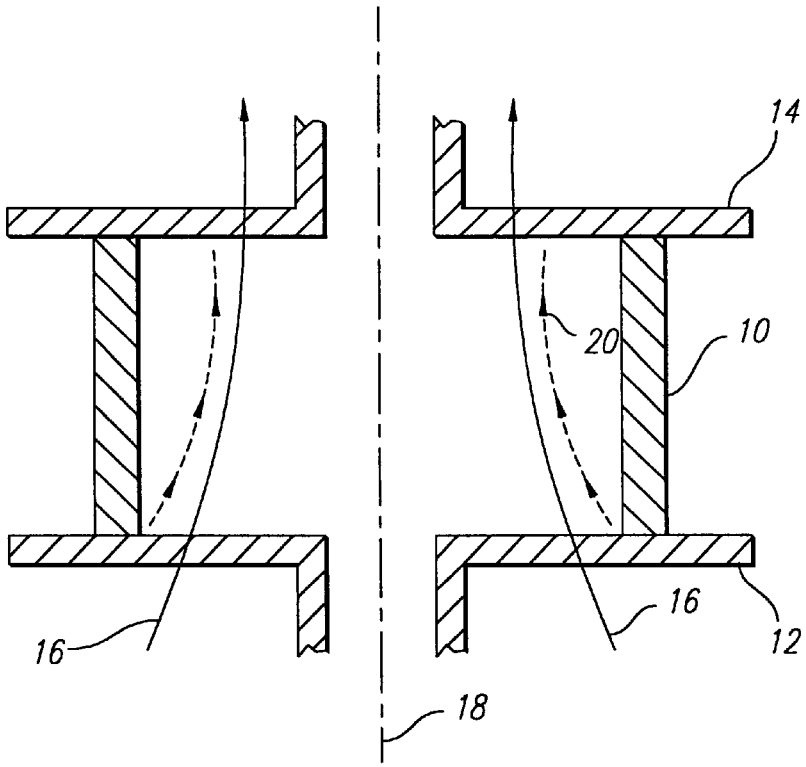
FIG. 2 PRIOR ART
FIG. 2 is a side sectional view of a portion of a prior art klystron.
Figure 3:
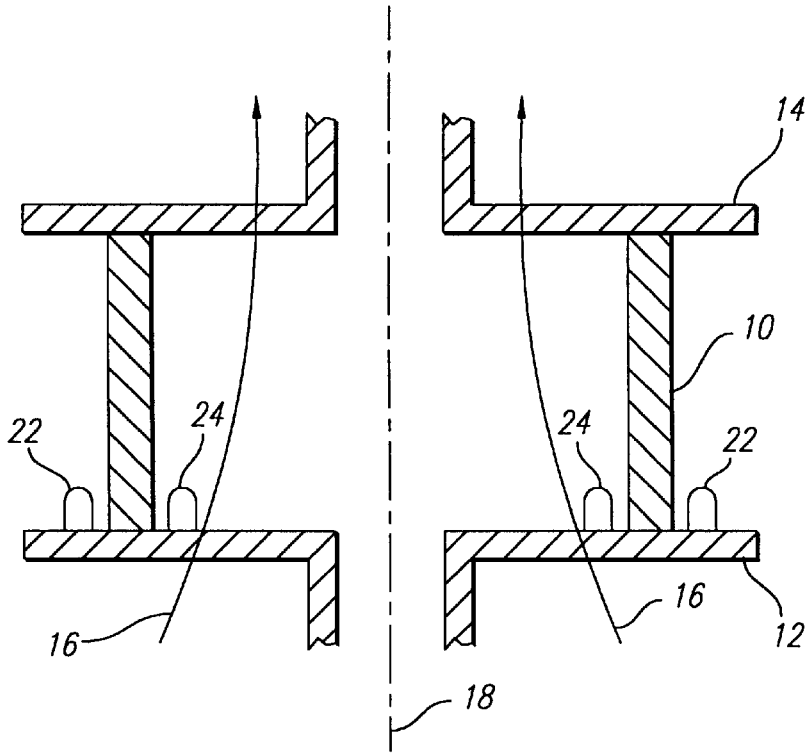
FIG. 3 PRIOR ART
FIG. 3 is a side sectional view of a portion of a prior art klystron modified to prevent the triple-junction effect.

The present invention satisfies the need for a thermionic electron emitter that takes advantage of the triple-junction effect. In the detailed description that follows, it should be appreciated that like reference numerals are used to identify like elements illustrated in one or more of the figures.

Figure 4:
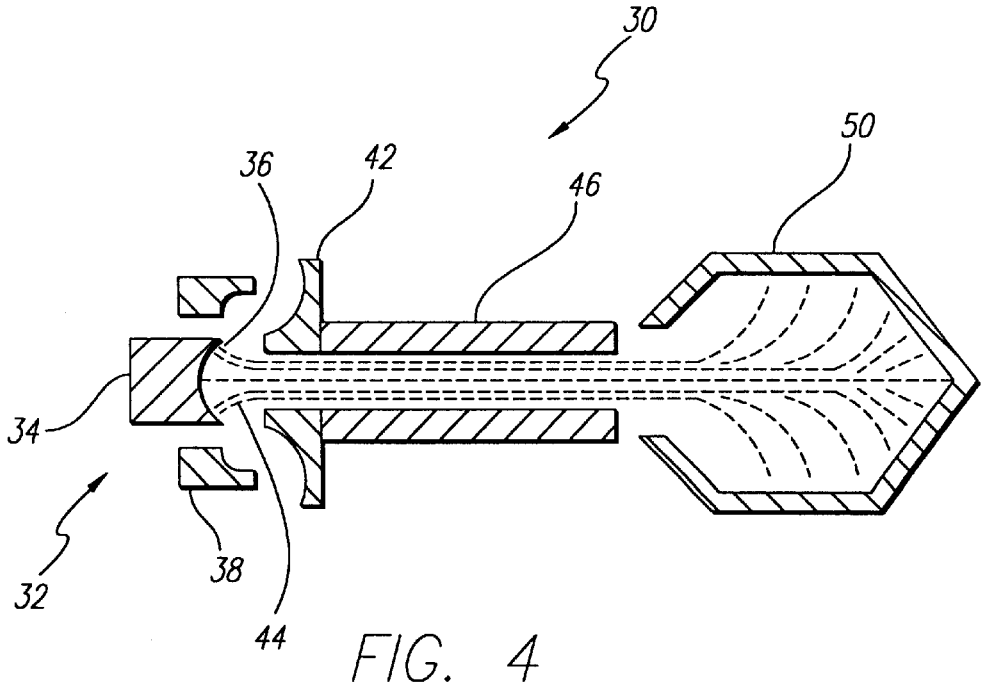
FIG. 4 is a side sectional view of an electron beam device in accordance with an 20 embodiment of the present invention.

Referring first to FIG. 4, a side sectional view of an electron beam device 30 in accordance with an embodiment of the present invention is illustrated. The electron beam device 30 includes an electron gun section 32, an RF interaction section 46, and a collector section 50. The electron gun section 32 includes a cathode 34 having a cathode surface 36 that can emit electrons. A heater coil (not shown) may be placed within the cathode 34 or some other device for heating the cathode 34 may be provided, as known in the art. The heater is used to raise the temperature of the cathode 34 sufficiently to permit thermionic emission of electrons from the cathode surface 36. An annular focus electrode 38 is disposed concentrically around the outer peripheral portion of the cathode surface 36.

An anode 42 defines an annular opening through which an electron beam 44 will travel. A positive voltage potential, with respect to the cathode 34, is applied to the anode 42 to define an electric field between the cathode surface 36 and the anode 42. The cathode 34 and the focus electrode 38 may be commonly coupled together at ground voltage potential. Alternatively, the anode 42 may be coupled to ground and a negative voltage potential with respect to the anode 42 may be applied to the cathode 34 and the focus electrode 38. The anode 42 draws the electrons from the cathode surface 36, focuses the electrons into an electron beam 44, and accelerates the electron beam 44 into the RF interaction section 46.

Within the RF interaction section 46, the electron beam 44 interacts with a RF signal such that energy from the electron beam 44 is transferred to the RF signal. At the end of the RF interaction section 46, the spent electrons of the electron beam 44 enters the collector section 50, which recovers the remaining energy of the electron beam 44.

With respect to the triple-junction phenomena discussed above, a corona problem was investigated involving a metal-insulator junction in air, and a hypothesis developed that might explain the enhanced emission without requiring gaps or sharp edges of metal to be present at the triple-junction region. The hypothesis is based on the observation that, even with the plain parallel equipotentials and parallel electric field lines that would exist between two plain parallel metal plates separated by a cylindrical dielectric insulator, the electric displacement vector and consequently, the surface charge under the ends of the insulator, will be higher than the surface charge outside of the region contacted by the insulator. In theory, there will be an abrupt step function in the surface charge density in the metal at the edges of the insulator; however, the abrupt step function theory tends to be refuted by the maxim that "nature does not like discontinuities." There is good reason to believe that because of the thermal motion of electrons within the metal, the charge density discontinuity cannot, in fact, be abrupt, but rather will reflect the thermal motion of the electrons. For this reason, just outside the insulator, most of the time, there will be greater electron density in the conduction band of the metal than is required to terminate the electric displacement vector. Therefore, it would not be surprising if some of these electrons were to escape from the metal into either vacuum or air.

Figure 5:
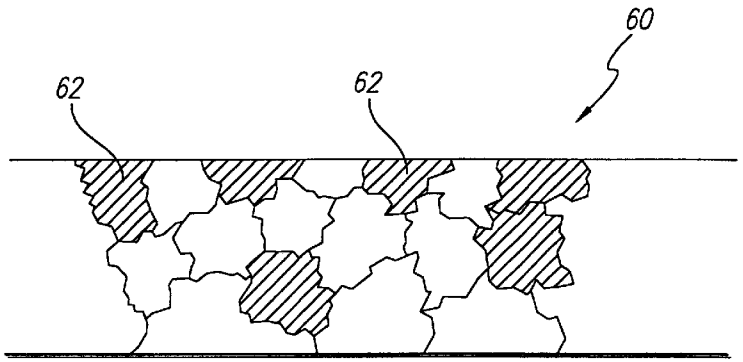
FIG. 5 is a side sectional view of a portion of a cathode in accordance with an embodiment of the present invention.

Based on this hypothesis, the emission of electrons from a triple junction would be directly related to a function of temperature. For example, a cathode surface composed of many grains of insulating material buried in the surface of a conductor should provide copious amounts of electron emission when heated. Currently, oxide-coated cathodes and tungsten matrix cathodes impregnated with barium calcium aluminate may indirectly benefit from this hypothesis. But the hypothesis may be utilized to predict performance of other types of cathode materials to achieve desirable properties. Specifically, by increasing the dielectric constant of the insulator, higher electron emissions may be achieved as readily as current methods that decrease the work function of the metal. As an example of this principle of selecting the insulator based upon the dielectric constant, FIG. 5 shows a side sectional view of a cathode 60 in accordance with an embodiment of the present invention. A high dielectric constant material 62 is impregnated in the cathode 60 that may be comprised of a tungsten matrix material. The high dielectric constant material 62 may comprise a ferroelectric material such as barium titanate ($BaTiO_3$), lithium niobate ($LiNbO_3$), or other known ferroelectric material.

Figure 6:
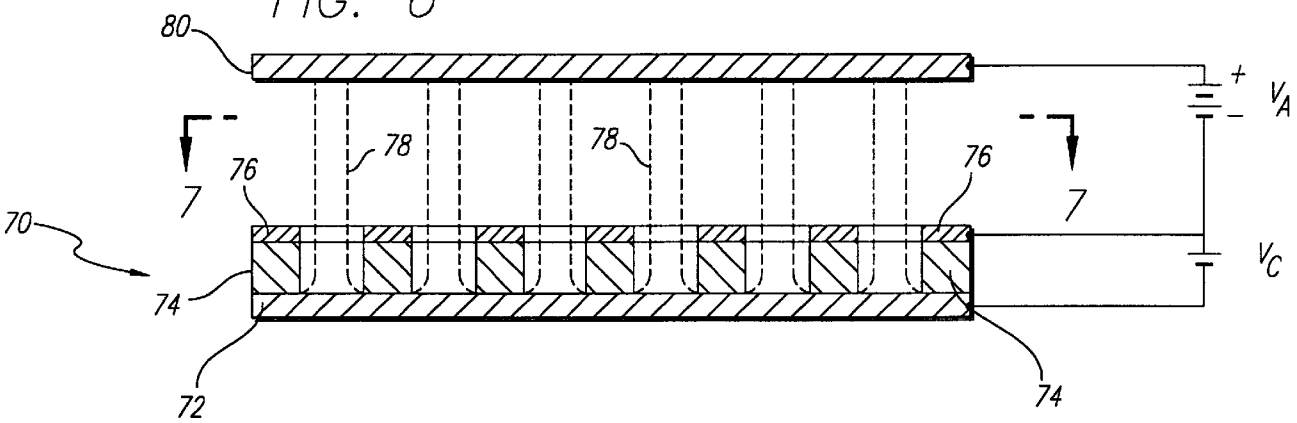
FIG. 6 is a side sectional view of a cathode in accordance with a second embodiment of the present invention.

Referring to FIG. 6, a side sectional view of a cathode 70 in accordance with a second embodiment of the present invention is shown. The cathode 70, based on the triple-junction effect, includes a metal plate cathode 72, a metal layer 76, and a high dielectric constant material 74 disposed between the metal plate cathode 72 and the metal layer 76. The high dielectric constant material 74 may be a coating applied to the metal plate cathode 72 or it may be a thin layer of material adjacent to the metal plate cathode 72. The high dielectric constant material 74 and the metal layer 76 will be perforated with a number of holes, with the hole pattern of the two layers being in substantial alignment. The metal plate cathode 72 may be comprised of a tungsten matrix material. The high dielectric constant material 74 may be comprised of a ferroelectric material such as barium titanate or lithium niobate.

In operation, the cathode 70 would emit a stream of electrons 78 by applying a positive voltage, $V_C$, to the metal layer 76 with respect to the voltage potential of the metal plate cathode 72. The stream of electrons 78 includes the electrons generally emitted from the metal plate cathode 72 along with the electrons emitted from the junction between the metal plate cathode 72 and the high dielectric constant material 74. An anode 80 is shown drawing the electrons from the cathode 70 by having a positive voltage potential, $V_A$, with respect to the voltage potential, $V_C$, of the metal layer 76. The current per unit area from the cathode 70 should increase as the total periphery of all of the holes in the unit area increases. Because the number of holes per unit area will be inversely proportional to the square of their diameter, and the periphery of an individual hole will be proportional to the diameter, the total periphery or the current will be inversely proportional to the size of the holes.

Figure 7:
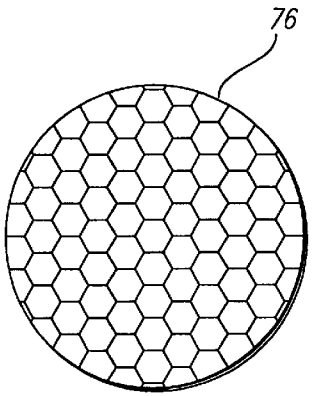
FIG. 7 is a cross sectional view taken through section 7—7 of FIG. 6.

FIG. 7 shows a cross sectional view taken through section 7—7 of FIG. 6. This view illustrates a hole pattern for the metal layer 76 and the high dielectric constant material 74. As discussed above, the perforations of the metal layer 76 will be in substantial alignment with the perforations of the high dielectric constant material 74. As shown for this embodiment, the hole pattern in the metal layer 76 is hexagonal; however, various other hole patterns may be utilized such as circular, triangular, square, or other grid-like, random or geometric shapes. It should also be understood that, although the overall shape of the metal layer 76 is shown as round, the metal layer 76 and also the cathode 70 may comprise any shape and the surface may be curved or conformed to other types of shapes.

Figure 8:
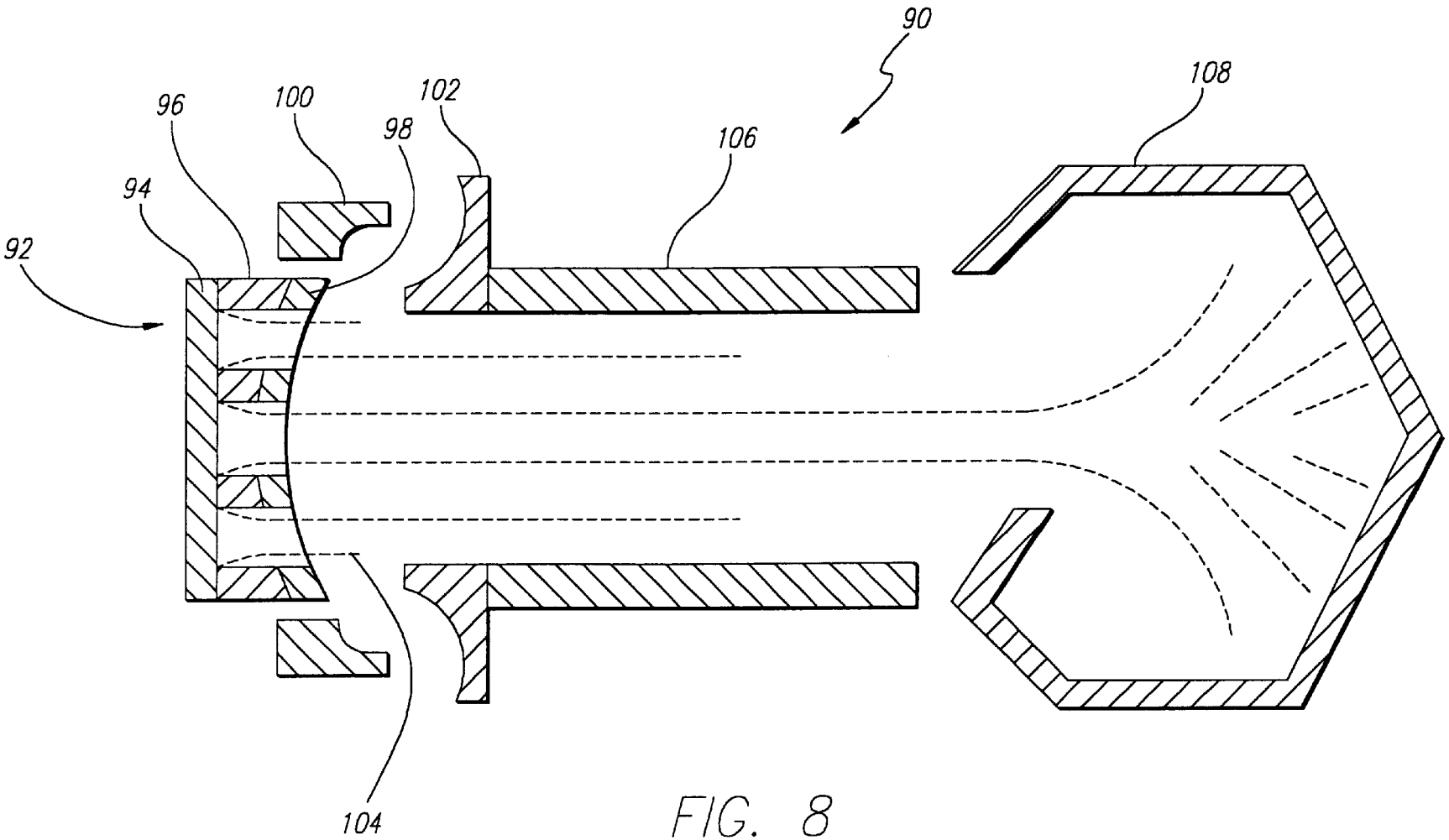
FIG. 8 is a side sectional view of an electron beam device in accordance with a second embodiment of the present invention.

FIG. 8 shows a side sectional view of an electron beam device 90 in accordance with the second embodiment of the present invention. The electron beam device 90 includes a cathode 92 comprised of a metal plate cathode layer 94, a high dielectric constant material 96, and a metal layer 98. A form of heat (not shown) may be applied to the cathode 92 to raise the temperature sufficiently to permit thermionic emission of electrons from the cathode 92. Similarly as discussed above with respect to FIG. 6, the cathode 92 is intended to take advantage of the triple-junction effect. The high dielectric constant material 96 and the metal layer 98 have perforations that are in substantial alignment. The cathode 92 will emit a stream of electrons through the perforations by applying a positive voltage to the metal layer 98 with respect to the voltage potential of the metal plate cathode 94.

An annular focus electrode 100 is disposed concentrically around the outer peripheral portion of the cathode 92 and may be at the same voltage potential as the metal layer 98. An anode 102 defines an annular opening through which an electron beam 104 will travel. A positive voltage potential, with respect to the metal layer 98, is applied to the anode 102 to define an electric field between the cathode 92 and the anode 102. The anode 102 draws the electrons from the cathode 92, focuses the electrons into an electron beam 104, and accelerates the electron beam 104 into a RF interaction section 106. Within the RF interaction section 106, the electron beam 104 interacts with a RF signal (not shown) such that energy from the electron beam 104 is transferred to the RF signal. At the end of the RF interaction section 106, the electron beam 104 enters a collector section 108, which recovers the remaining energy of the electron beam 104.

Having thus described a preferred embodiment of the thermionic electron emitter based upon the triple-junction effect, it should be apparent to those skilled in the art that certain advantages of the within system have been achieved. It should also be appreciated that various modifications, adaptations, and alternative embodiments thereof may be made within the scope and spirit of the present invention. For example, a basic electron beam device has been illustrated to show an embodiment of the present invention, but it should be apparent that the inventive concepts described above would be equally applicable to many different types of devices that utilize a cathode to emit electrons, such as a cathode ray tube, a cold-cathode gas tube, a flat panel display, a triode, a tetrode, a pentode, a magnetron, and a crossed-field amplifier, as known in the art.

The invention is further defined by the following claims. What is claimed is:

1. An electron emissive cathode, comprising:

a first layer having an emitting surface for emitting electrons therefrom;

a second layer spaced from said first layer, said second layer having a first plurality of apertures;

means for applying a voltage between said first and second layers; and a high dielectric constant material disposed between said first layer and said second layer, said high dielectric constant material having a second plurality of apertures in substantial alignment with said first plurality of apertures, wherein a stream of electrons emitted from said first layer includes electrons emitted from a junction between said first layer and said high dielectric constant material.

2. The cathode of claim 1, wherein said first and second layers are comprised of a metal material.

3. The cathode of claim 1, wherein said first layer is comprised of a tungsten matrix material.

4. The cathode of claim 1, wherein said high dielectric constant material is comprised of a ferroelectric material.

5. The cathode of claim 1, wherein said high dielectric constant material is comprised of at least one of a barium titanate and a lithium niobate.

6. The cathode of claim 1, wherein said high dielectric constant material is comprised of a coating applied to said first layer.

7. The cathode of claim 1, wherein a shape of each aperture of said first and second plurality of apertures comprises at least one of a hexagon, a triangle, a circle, and a square.

8. An electron beam device, comprising:

a cathode;

a collector spaced from said cathode to collect electrons of an electron beam emitted by said cathode;

a radio frequency interaction section disposed between said cathode and said collector to enable an interaction between a radio frequency signal and said electron beam;

an anode disposed between said cathode and said radio frequency interaction section drawing said electron beam from said cathode;

wherein said cathode is comprised of:

a first layer having an emitting surface for emitting said electron beam;

a second layer spaced from said first layer, said second layer having a first plurality of apertures;

means for applying a voltage between said first and second layers; and a high dielectric constant material disposed between said first layer and said second layer, said high dielectric constant material having a second plurality of apertures in substantial alignment with said first plurality of apertures, wherein said electron beam is emitted from said first layer including electrons emitted from a junction between said first layer and said high dielectric constant material.

9. The electron beam device of claim 8, wherein said first and second layers are comprised of a metal material.

10. The electron beam device of claim 8, wherein said first layer is comprised of a tungsten matrix material.

11. The electron beam device of claim 8, wherein said high dielectric constant material is comprised of a ferroelectric material.

12. The electron beam device of claim 8, wherein said high dielectric constant material is comprised of at least one of a barium titanate and a lithium niobate.

13. The electron beam device of claim 8, wherein said high dielectric constant material is comprised of a coating applied to said first layer.

14. The electron beam device of claim 8, wherein a shape of each aperture of said first and second plurality of apertures comprises at least one of a hexagon, a triangle, a circle, and a square.

15. The electron beam device of claim 8, further comprising at least one of a klystron, a traveling wave tube, a triode, a tetrode, and a pentode.

16. A method for fabricating an electron emissive cathode, comprising:

providing a first layer having an emitting surface for emitting electrons therefrom;

disposing a high dielectric constant material on said first layer;

providing a second layer on said high dielectric constant material spaced from said first layer;

forming a first plurality of apertures in said second layer and a second plurality of apertures in said high dielectric constant material in substantial alignment with said first plurality of apertures; and selecting at least one of size and shape of said first and second apertures so as to maximize a proportion of total periphery to unit area of said first and second apertures, wherein a stream of electrons emitted from said first layer includes electrons emitted from a junction between said first layer and said high dielectric constant material and proportion of said electrons emitted from said junction is maximized.

17. The method of claim 16, further comprising selecting a metal material for at least one of said first and second layers.

18. The method of claim 16, further comprising selecting a ferroelectric material for said high dielectric constant material.

19. The method of claim 16, wherein said selecting step further comprises selecting a shape of said first and second apertures from at least one of a hexagon, a triangle, a circle and a square.

* * * * *